US012691917B2

(12) United States Patent
Applegate

(10) Patent No.: US 12,691,917 B2
(45) Date of Patent: Jul. 28, 2026

(54) SYSTEM FOR TESTING RAILROAD CROSSING SIGNALS

(71) Applicant: BNSF Railway Company, Fort Worth, TX (US)

(72) Inventor: Joshua A. Applegate, Queen City, MO (US)

(73) Assignee: BNSF Railway Company

( * ) Notice: Subject to any disclaimer, the term of this patent is extended or adjusted under 35 U.S.C. 154(b) by 461 days.

(21) Appl. No.: 18/353,628

(22) Filed: Jul. 17, 2023

(65) Prior Publication Data

US 2025/0026389 A1 Jan. 23, 2025

(51) Int. Cl.
*B61L 27/53* (2022.01)

(52) U.S. Cl.
CPC ..... *B61L 27/53* (2022.01)

(58) Field of Classification Search
CPC ..... B61L 27/53
See application file for complete search history.

(56) References Cited

U.S. PATENT DOCUMENTS 4,703,303 A * 10/1987 Snee ..... B61L 29/288 246/292
5,461,908 A * 10/1995 Armstrong ..... F02P 17/02 73/114.61
5,986,462 A * 11/1999 Thomas ..... G01R 31/008 324/73.1
6,028,597 A * 2/2000 Ryan, Jr. ..... G09G 3/06 345/82
6,222,446 B1 * 4/2001 Hilleary ..... B60Q 11/00 315/132
6,327,507 B1 * 12/2001 Buchan ..... H02G 11/02 191/12.4
7,061,248 B1 * 6/2006 Holland ..... G01R 35/04 324/508
8,028,961 B2 * 10/2011 Ashraf ..... B61L 29/282 246/167 R
11,208,131 B2 * 12/2021 Young ..... B61L 13/002
2002/0008629 A1 * 1/2002 Jinno ..... G08G 1/097 340/642

(Continued)

OTHER PUBLICATIONS

Tek Tracking; Safety Light Monitor, https://tektracking.com—connected crossing, Sep. 19, 2020.

*Primary Examiner* — Jess Whittington
(74) *Attorney, Agent, or Firm* — Whitaker Chalk Swindle & Schwartz PLLC; Bradley J. Birchfield; Enrique Sanchez, Jr.

(57) ABSTRACT

A railroad crossing signal test system includes a power source, a timer device configured to provide periodic electrical pulses, and first and second relays. The first relay can be configured to alternately provide the periodic electrical pulses to a left and right light of the railroad crossing signal. The second relay can be configured to alternately change a polarity of a common connection between the left light and the right light of the railroad crossing signal. The test system also includes a first switch configured to test a bell of the railroad crossing signal, a second switch configured to enable flashing of the left light according to the periodic electrical pulses, and a third switch configured to enable flashing of the right light according to the periodic electrical pulses. The system also includes test leads for electrically coupling the test system to test terminals of the railroad crossing signal.

20 Claims, 4 Drawing Sheets

(56) References Cited

U.S. PATENT DOCUMENTS

| | | | | |
|---|---|---|---|---|
| 2004/0182970 | A1* | 9/2004 | Mollet | B61L 29/30<br>246/473 R |
| 2011/0144933 | A1* | 6/2011 | Hoelscher | G01R 35/00<br>340/815.4 |
| 2019/0344815 | A1* | 11/2019 | Denny | B61L 27/53 |
| 2019/0348815 | A1 | 11/2019 | Denny et al. | |
| 2022/0073116 | A1* | 3/2022 | Pittman | B61L 25/021 |
| 2022/0363297 | A1* | 11/2022 | Pittman | B61L 25/021 |
| 2022/0416693 | A1* | 12/2022 | Reed | H02P 5/50 |
| 2025/0008306 | A1* | 1/2025 | Allsbrook | G16Y 40/10 |

* cited by examiner

SYSTEM FOR TESTING RAILROAD CROSSING SIGNALS

TECHNICAL FIELD

This disclosure relates generally to railroad crossing signals, and more particularly to a system for testing railroad crossing signals.

BACKGROUND

Railroad crossing signals play an important role in railroad safety. Most railroad crossing signals include a bell to audibly alert and multiple lights to visually alert the public to the presence of a train. The bells and lights of railroad crossing signals, which include numerous electrical components, wires, and connectors, are typically installed during the manufacture of the railroad crossing signal. The transportation of a railroad crossing signal to a railroad crossing installation site may cause defects in the electrical wires or connectors for the bell and lights. Furthermore, manufacturing errors or defects may cause the bell or lights of a railroad crossing signal to not be functional. These defects may go unnoticed until after the complete installation of the railroad crossing signal at the installation site, thereby causing increased installation costs and time.

SUMMARY

The present disclosure achieves technical advantages as a system for testing railroad crossing signals. Typically, railroad crossing signals are manufactured and shipped to a railroad crossing installation site where they are installed with little or no testing. This may result in any defects in the bell and lights of the crossing signal being discovered after the complete installation of the crossing signal. As a result, workers may be required to diagnose and repair defects in the crossing signal under dangerous conditions (e.g., using ladders). To address these and other problems with installing railroad crossing signals, the disclosed embodiments provide systems for easily and quickly testing railroad crossing signals in the field prior to their raising and installation.

The present disclosure solves the aforementioned technological problem via a small, portable device that can be coupled to terminals in a railroad crossing joint box while a mast is being built. An employee can turn on a switch to verify bell functions, and LED light operation along with properly light syncing. Advantageously, the device can be powered by readily-available removable power tool batteries (e.g., Milwaukee or DeWalt 18V batteries) that are stepped down to an operational voltage via a regulator. This can ensure function test with the proper voltage every time.

In one embodiment, providing a railroad crossing signal test system that can include a power source, a timer device, a voltage regulator electrically coupled to the power source, a first relay and a second relay, and a plurality of test leads. The plurality of test leads includes a first test lead and a second test lead configured to operate a bell of a railroad crossing signal, a third test lead configured to operate a left light of the railroad crossing signal, a fourth test lead configured to operate a right light of the railroad crossing signal, and a fifth test lead configured to energize a common connection between the left light and the right light of the railroad crossing signal. The railroad crossing signal test system further includes a plurality of switches that includes a first switch configured to operate the bell of the railroad crossing signal, a second switch configured to enable flashing of the left light of the railroad crossing signal, a third switch configured to enable flashing of the right light of the railroad crossing signal, and a fourth switch configured to enable the railroad crossing signal test system. The first switch can be electrically coupled to the first test lead and an output of the voltage regulator and can be configured to supply power from the voltage regulator to the first test lead. The second switch can be electrically coupled to a coil of the second relay and a normally-closed terminal of the first relay. The third switch can be electrically coupled to the fourth test lead and a normally-open terminal of the first relay. The fourth switch can be electrically coupled to the power source and the voltage regulator. The timer device can be electrically coupled to a coil of the first relay and can be configured to provide periodic electrical pulses. The second test lead can be electrically coupled to the output of the voltage regulator. The third test lead can be electrically coupled to a normally-closed terminal of the second relay. The fifth test lead can be electrically coupled to a common terminal of the second relay.

In another embodiment, a railroad crossing signal test system includes a power source, a timer device electrically coupled to the power source and configured to provide periodic electrical pulses, a first relay configured to alternately provide the periodic electrical pulses from the timer to a left light and a right light of a railroad crossing signal, and a second relay configured to alternately change a polarity of a common connection between the left light and the right light of the railroad crossing signal. The railroad crossing signal test system further includes a plurality of test leads configured to electrically couple the railroad crossing signal test system to test terminals of the railroad crossing signal. The railroad crossing signal test system further includes a plurality of switches that includes a first switch configured to test a bell of the railroad crossing signal, a second switch configured to enable flashing of the left light of the railroad crossing signal according to the periodic electrical pulses, and a third switch configured to enable flashing of the right light of the railroad crossing signal according to the periodic electrical pulses.

In another embodiment, a railroad crossing test box can include: a battery receiver configured to receive a removable battery; a voltage regulator coupled to the battery and configured to step down a voltage received from the battery; a first relay configured to provide the stepped-down voltage to a first group of railroad crossing notification devices; a second relay configured to provide the stepped-down voltage to a second group of railroad crossing notification devices; wherein the relays are activated to verify the proper operation of railroad crossing notification devices; wherein the relays are activated to verify the proper syncing of railroad crossing notification devices; wherein the railroad crossing notification devices include lights, bells, or speakers; wherein the railroad crossing test box can be configured to removably attach to a railroad crossing mast; and wherein the removable battery can be a power tool battery.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiments disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the disclosed embodiments and their features and advantages, reference is now made to the following description, taken in conjunction with the accompanying drawings, in which.

Figure 1:
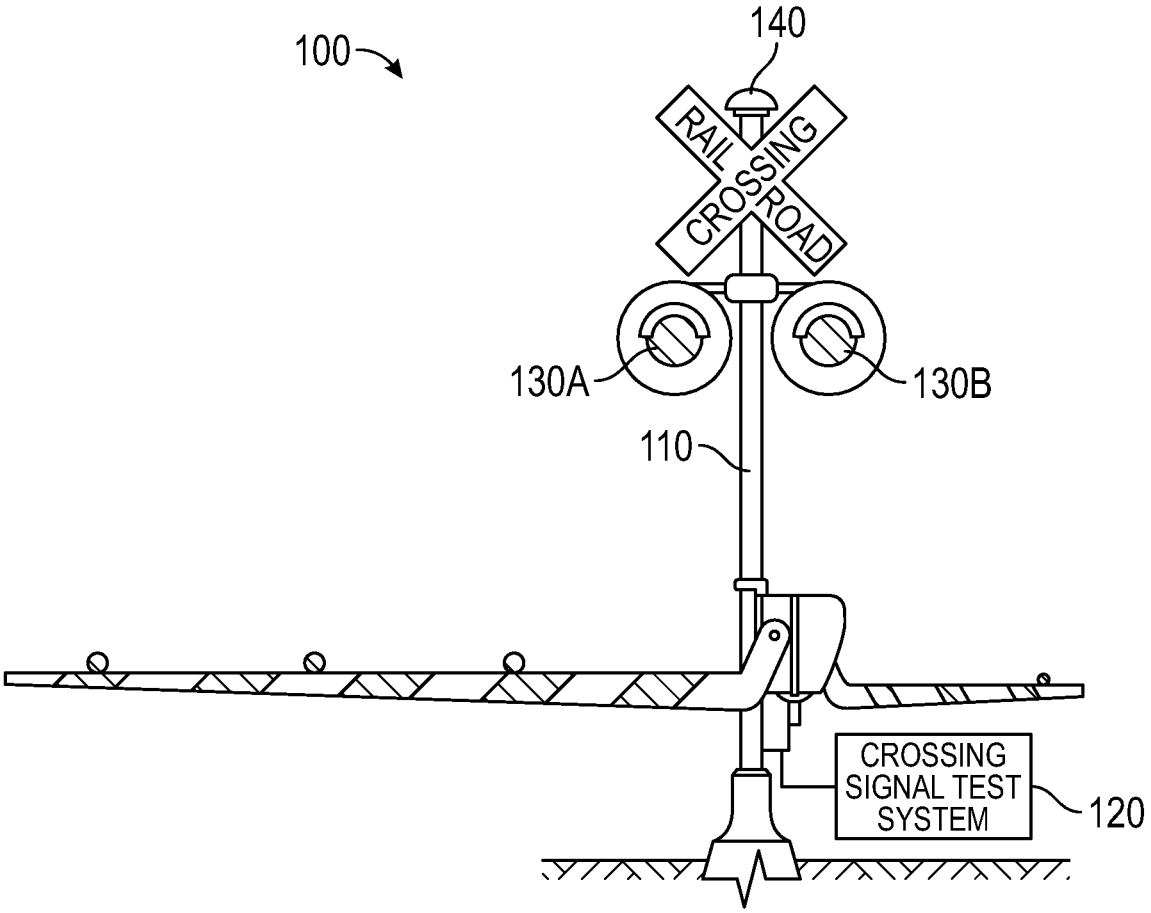
FIG. 1 is a diagram illustrating a crossing signal test system within a railroad crossing environment, in accordance with one or more exemplary embodiments.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, as evidenced by issuance of this patent, the prior art fails to disclose or teach the elements and limitations presented in the claims as enabled by the specification and drawings, such that the presented claims are patentable under the applicable laws and rules of this jurisdiction.

Railroad crossing signals play an important role in railroad safety. Most railroad crossing signals include a bell to audibly alert and multiple lights to visually alert the public to the presence of a train. The bells and lights of railroad crossing signals, which include numerous electrical components, wires, and connectors, are typically installed during the manufacture of the railroad crossing signal. The transportation of a railroad crossing signal to a railroad crossing installation site may cause defects in the electrical wires or connectors for the bell and lights. Furthermore, manufacturing errors or defects may cause the bell or lights of a railroad crossing signal to not be functional. These defects may go unnoticed until after the installation of the railroad crossing signal at the installation site, thereby causing increased installation costs and time.

To address these and other problems with installing railroad crossing signals, the disclosed embodiments provide systems for easily and quickly testing railroad crossing signals in the field prior to their raising and installation. In some embodiments, the railroad crossing signal test system can be a small, portable, self-contained unit that may be easily transported to a railroad crossing signal installation site and connected to test terminals of the railroad crossing signal. The railroad crossing signal test system includes switches that may be selectively enabled in order to test the functionality of various components of the railroad crossing signal. For example, the railroad crossing signal test system may include a switch that enables a bell of the railroad crossing signal. As another example, the railroad crossing signal test system may include one or more switches to test lights of the railroad crossing signal. These tests may be performed on the railroad crossing signal prior to its raising and installation. As a result, workers may quickly and easily identify defects in the railroad crossing signal prior to can be permanent installation. These and other features and advantages of the disclosed embodiments are discussed in more detail below.

FIG. 1 is a diagram illustrating a railroad crossing signal test system 120 within a railroad crossing environment 100, according to particular embodiments. In general, railroad crossing environment 100 includes a railroad crossing signal 110 that is to be installed (or has already been installed) at a point where a road crosses railroad tracks. Railroad crossing signal 110 may include a bell 140 and multiple lights 130 (e.g., 130A-130B) in order to visually and audibly warn the public of the presence of a train at the crossing. Bell 140 may be any appropriate device for emitting sound (e.g., an electro-mechanical bell, an electrical horn, etc.). Lights 130 may be any appropriate light technology (e.g., LED, incandescent, etc.) in any appropriate shape and color. In some embodiments, railroad crossing signal 110 includes one or more left lights 130A and one or more rights lights 130B. For example, railroad crossing signal 110 may include two left lights 130A that point in opposite directions and two right lights 130B that point in opposite directions. Lights 130, when activated, may flash in an alternating pattern such that left lights 130A and right lights 130B are prevented from being illuminated at the same time.

In some embodiments, railroad crossing signal test system 120 can be a small, portable, self-contained unit that may be easily transported to railroad crossing environment 100 and connected to test terminals (e.g., test terminals 215 described below) of railroad crossing signal 110. Railroad crossing signal test system 120 includes switches (e.g., switches 220 described below) that may be selectively enabled in order to test the functionality of various components of railroad crossing signal 110. For example, railroad crossing signal test system 120 may include a switch that enables bell 140 of railroad crossing signal 110. As another example, railroad crossing signal test system 120 may include one or more switches to test lights 130 of the railroad crossing signal. These tests may be performed on railroad crossing signal 110 prior to its raising and permanent installation. As a result, workers may quickly and easily identify defects in the railroad crossing signal prior to its permanent installation. This may prevent awkward or dangerous work conditions (e.g., working on a ladder) that would otherwise be encountered by workers in order to repair railroad crossing signal 110 after its raising and installation. A specific example embodiment of railroad crossing signal test system 120 is discussed below in reference to FIGS. 2-3.

Figure 2:
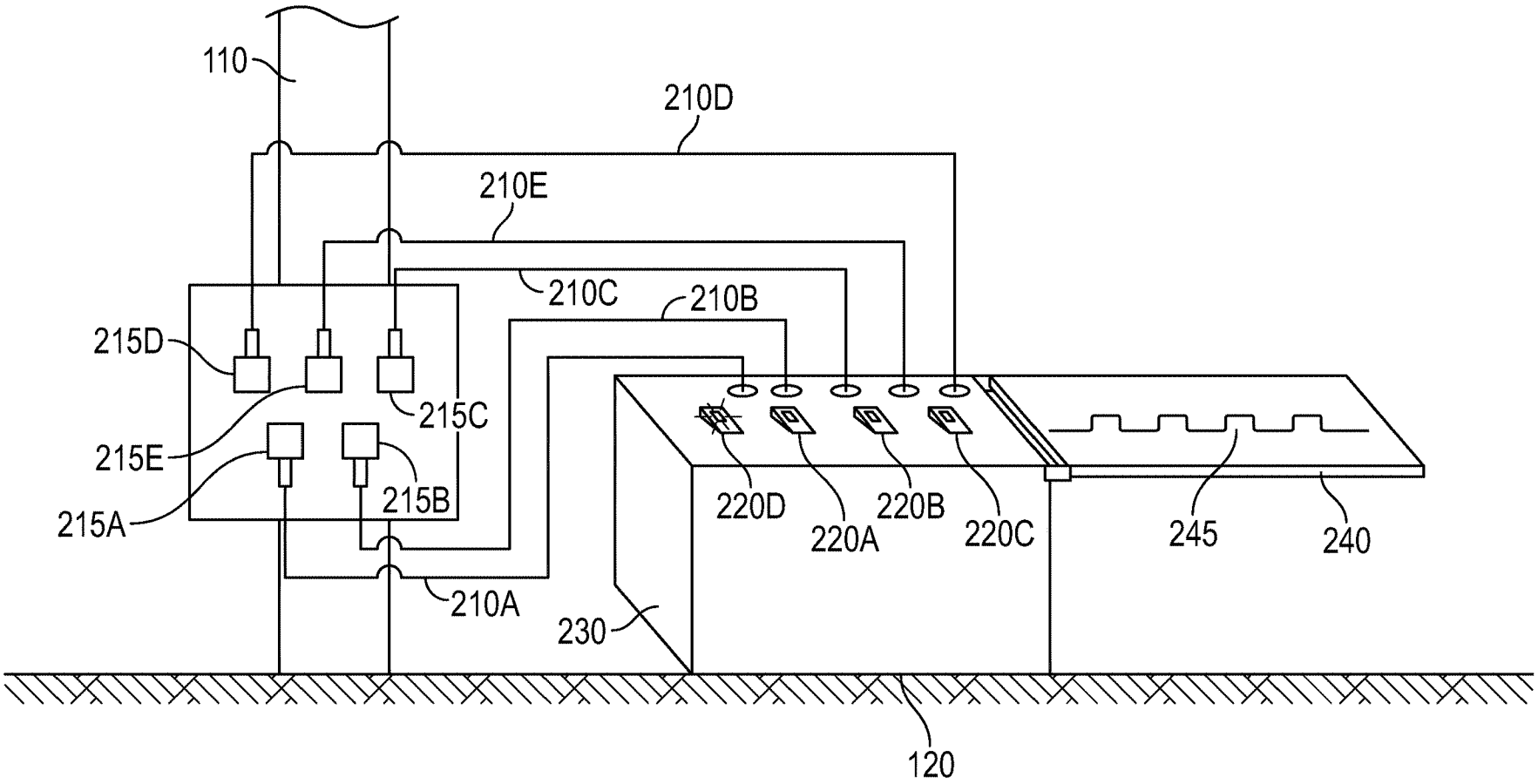
FIG. 2 is a diagram illustrating more details of the crossing signal test system of FIG. 1, in accordance with one or more exemplary embodiments.

FIG. 2 is a diagram illustrating more details of railroad crossing signal test system 120, according to particular embodiments. In this embodiment, railroad crossing signal test system 120 includes multiple test leads 210 (e.g., 210A-210E), multiple switches 220 (e.g., 220A-220D), and an enclosure 230 with a lid 240. In this illustration, railroad crossing signal test system 120 has been connected to railroad crossing signal 110 using test leads 210. More specifically, test leads 210 of railroad crossing signal test system 120 have been physically connected to test terminals 215 (e.g., 215A-215E) of railroad crossing signal 110. Test terminals 215 may be located, for example, in an electrical junction box of railroad crossing signal 110 located near a lower portion of railroad crossing signal 110.

Test leads 210 are electrical wires or cables that electrically couple railroad crossing signal test system 120 to railroad crossing signal 110. In some embodiments, each test lead 210 includes a physical end connector such as an alligator clip that allows test lead 210 to easily and quickly connect and disconnect from a test terminal 215. In some embodiments, test leads 210 are any appropriate length and are retractable into enclosure 230 where they may be stored.

In the illustrated embodiment of FIG. 2, railroad crossing signal test system 120 includes a first test lead 210A, a second test lead 210B, a third test lead 210C, a fourth test lead 210D, and a fifth test lead 210E. First test lead 210A and second test lead 210B are configured to operate bell 140. For example, first test lead 210A may be a ground connection to bell 140 and second test lead 210B may be a positive/power connection to bell 140. Third test lead 210C can be configured to operate left light 130A of railroad crossing signal 110, and fourth test lead 210D can be configured to operate right light 130B of railroad crossing signal 110. Fifth test lead 210E can be configured to energize a common connection between left light 130A and right light 130B of railroad crossing signal 110, as illustrated in more detail with reference to FIG. 3 below.

Test terminals 215 are any appropriate electrical connectors coupled to railroad crossing signal 110 that permit electrical connections to the various operating components of railroad crossing signal 110. For example, test terminals 215A-215B provide electrical connections to bell 140, and test terminals 215C-215E provide electrical connections to lights 130A-130B of railroad crossing signal 110. In some embodiments, test terminal 215 are physically located inside an electrical junction box near the base of railroad crossing signal 110.

Switches 220 are any appropriate user-selectable physical objects for selectively enabling and disabling various test objects of railroad crossing signal 110. In some embodiments, switches 220 are rocker-style switches that may be toggled between an on position and an off position. In the illustrated embodiment of FIG. 2, railroad crossing signal test system 120 includes a first switch 220A, a second switch 220B, a third switch 220C, and a fourth switch 220D. First switch 220A can be configured to operate bell 140 of railroad crossing signal 110 when first switch 220A can be in the on position. Second switch 220B can be configured to enable flashing of left light 130A of railroad crossing signal 110 when second switch 220B can be in the on position. Third switch 220C can be configured to enable flashing of right light 130B of railroad crossing signal 110 when third switch 220C can be in the on position. Fourth switch 220D can be configured to enable (e.g., to provide power to) railroad crossing signal test system 120 when fourth switch 220D can be in the on position. The various electrical connections of switches 220A-220D are described in more detail below with reference to FIG. 3.

In some embodiments, each switch 220 includes a light (e.g., an LED) that illuminates when switch 220 can be in the on position. For example, when fourth switch 220D can be in the on position, an LED light within fourth switch 220D may be constantly illuminated to indicate that railroad crossing signal test system 120 can be powered on. As another example, an LED light within first switch 220A may be constantly illuminated to indicate that bell 140 has been enabled. As yet another example, LED lights within switches 220B-C may flash in synchronization with the flashing of their respective lights 130 of railroad crossing signal 110. Specifically, an LED light within second switch 220B may be configured to flash in synchronization with left light 130A and an LED light within third switch 220C may be configured to flash in synchronization with right light 130B of railroad crossing signal 110.

Enclosure 230 can be any appropriate housing for railroad crossing signal test system 120. Enclosure 230 may be any appropriate material (e.g., plastic, metal, etc.) and may be in any appropriate shape. In some embodiments, enclosure 230 can be a portable, light-weight container that may be transported by a single person to railroad crossing environment 100. In some embodiments, enclosure 230 includes a removeable lid 240 that may be opened/closed using one or more hinges. In some embodiments, lid 240 includes a handle (not illustrated) on an exterior surface and one or more raised features 245 on an opposite side of lid 240 from the handle. Raised features 245 are configured to disable switches 220 when lid 240 can be in a closed position on enclosure 230. Raised features 245 may be bumps, ridges, raised components, or any other appropriate structures of lid 240 that physically contact switches 220 and force switches 220 to their off positions when lid 240 can be closed or otherwise placed onto enclosure 230. In some embodiments, enclosure 230 includes apertures as illustrated in FIG. 2 that allow test leads 210 to retract into and be stored within enclosure 230.

Figure 3:
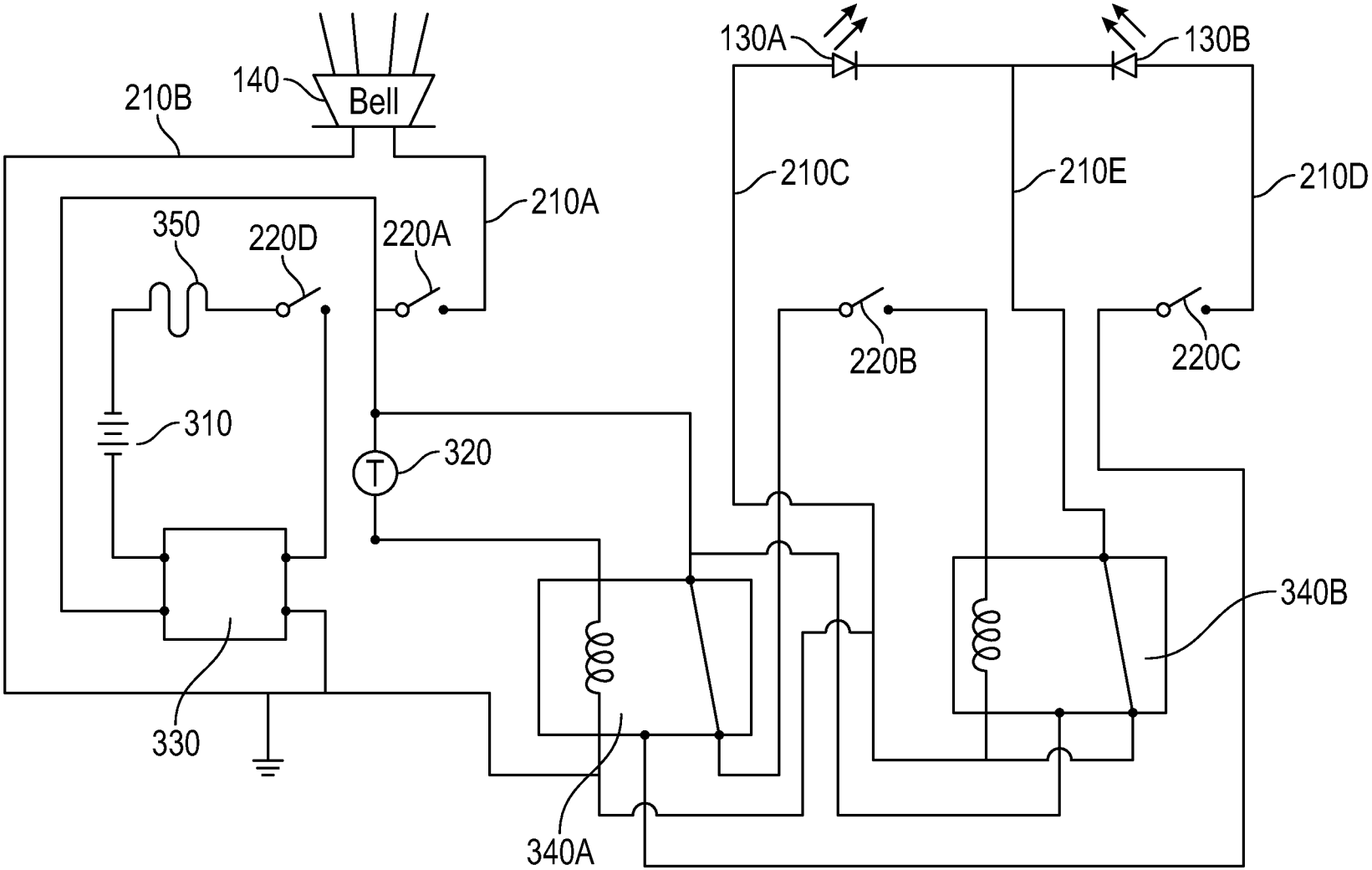
FIG. 3 is a circuit diagram illustrating components and electrical connections of the crossing signal test system of FIG. 1, in accordance with one or more exemplary embodiments.

FIG. 3 is a circuit diagram illustrating components and electrical connections of railroad crossing signal test system 120, according to particular embodiments. In addition to previously described switches 220, some embodiments of railroad crossing signal test system 120 include a power source 310, a timer device 320, a voltage regulator 330, relays 340 (e.g., 340A-340B), and a fuse 350, as illustrated in FIG. 3. While FIG. 3 includes bell 140 and lights 130A-130B, it should be understood that these components are located on railroad crossing signal 110 and are electrically coupled to railroad crossing signal test system 120 via test leads 210 as illustrated.

Power source 310 can be any AC or DC power source for railroad crossing signal test system 120. In some embodiments, power source 310 can be a battery that is both removable and rechargeable. For example, power source 310 may be an 18*v* rechargeable battery that is typically used for power tools (e.g., power drills and impact tools). In these embodiments, railroad crossing signal test system 120 may include one or more adapters that allow for the easy removal and installation of the rechargeable battery. The adapters can be keyed to receive any rechargeable battery type or manufacturer to facilitate power transfer from the battery to the system 120. The adapters may be stored inside enclosure 230 or, in alternate embodiments, may be mounted to the exterior of enclosure 230 to allow for a quick exchange of the rechargeable battery. The ground/negative terminal of power source 310 can be coupled to voltage regulator 330. The positive terminal of power source 310 may be coupled to switch 220D or directly to an input terminal of voltage regulator 330. In embodiments that include a fuse 350, fuse 350 can be installed at the positive terminal of power source 310 as illustrated in FIG. 3 (e.g., between power source 310 and fourth switch 220D).

Timer device 320 can be any appropriate electrical device for providing periodic electrical pulses that cause lights 130 to flash. In some embodiments, timer device 320 can be a discrete solid-state timing component. In other embodiments, timer device 320 may be implemented in software (e.g., computer system 400) or a programmable device such as a field-programmable gate array (FPGA) or application-specific IC (ASIC). As illustrated in FIG. 3, an input of timer device 320 can be electrically coupled to an output of voltage regulator 330 and an output of timer device 320 can be electrically coupled to a coil of relay 340A. In some embodiments, the periodic electrical pulses from timer device 320 cause lights 130 to flash between 35 and 65 flashes per minute.

Voltage regulator 330 can be electrically coupled to power source 310 and operates to create and maintain a fixed output voltage for the components of railroad crossing signal test system 120 using power source 310. In some embodiments, voltage regulator 330 can be a discrete electrical component. In some embodiments, voltage regulator 330 outputs 12 v DC. The positive voltage output of voltage regulator 330 can be coupled to fourth switch 220A, the input to timer device 320, a common terminal of relay 340A, and a normally-open terminal of relay 340B, as illustrated in FIG. 3.

Relays 340 are typical electrically-operated switches and include a first relay 340A and a second relay 340B. First relay 340A can be configured to alternately provide the periodic electrical pulses from timer device 320 to left light 130A and right light 130B of railroad crossing signal 110. As illustrated in FIG. 3, the output of timer device 320 can be electrically coupled to the coil of first relay 340A, the common terminal of first relay 340A can be electrically coupled to the regulated voltage output of voltage regulator 330, the normally-open terminal of first relay 340A can be electrically coupled to third switch 220C, and the normally-closed terminal of first relay 340A can be electrically coupled to second switch 220B.

Second relay 340B can be configured to alternately change the polarity (i.e., between positive and negative) of a common connection between left light 130A and right light 130B of railroad crossing signal 110. This facilitates the alternate flashing of left light 130A and right light 130B such that left light 130A and right light 130B are prevented from being illuminated at the same time. As illustrated in FIG. 3, second switch 220B can be electrically coupled to the coil of second relay 340B, the common terminal of second relay 340B can be electrically coupled to fifth test lead 210E, the normally-open terminal of second relay 340B can be electrically coupled to the regulated voltage output of voltage regulator 330, and the normally-closed terminal of second relay 340B can be electrically coupled to ground and third test lead 210C.

Test leads 210 are coupled to the circuit of FIG. 3 as illustrated. For example, first test lead 210A can be electrically coupled to first switch 220A, second test lead 210B can be electrically coupled to the ground output of voltage regulator 330, and third test lead 210C can be electrically coupled to the normally-closed terminal of second relay 340B. Furthermore, fourth test lead 210D can be electrically coupled to third switch 220C and fifth test lead 210E can be electrically coupled to the common terminal of second relay 340B.

Switches 220 are coupled to the circuit of FIG. 3 as illustrated. For example, first switch 220A can be electrically coupled to first test lead 210A and a regulated voltage output of voltage regulator 330. First switch 220A can be configured to supply power from voltage regulator 330 to bell 140 via first test lead 210A when in the on position. Second switch 220B can be electrically coupled to the coil of second relay 340B and the normally-closed terminal of first relay 340A. Third switch 220C can be electrically coupled to fourth test lead 210D and the normally-open terminal of first relay 340A. Fourth switch 220D can be electrically coupled to power source 310 (or, in some embodiments, fuse 350) and voltage regulator 330.

In operation and in reference to the example embodiments of FIG. 1-3, railroad crossing signal test system 120 may be transported and placed in close proximity to a railroad crossing signal 110 that can be to be tested. Lid 240 may be opened or otherwise removed from enclosure 230 in order to expose test leads 210 and switches 220. Next, test leads 210 may be extracted from enclosure 230 and individually connected to test terminals 215. For example, test leads 210A-210B may be connected to test terminals 215A-215B for bell 140 and test leads 210C-210E may be connected to test terminals 215C-215E for lights 130A and 130B. Next, a worker may enable railroad crossing signal test system 120 by operating switch 220D to the on position. Switches 220A-220C may then be selectively operated to their on positions in order to test the audible and visual components of railroad crossing signal 110. For example, switch 220A may be placed in its on position in order to test bell 140. As another example, switch 220B may be placed in its on position in order to test left light 130A. As yet another example, switch 220C may be placed in its on position in order to test right light 130B. To end testing of the audible and visual components of railroad crossing signal 110, switches 220 may be operated to their off positions. Alternatively, lid 240 may be closed or otherwise placed onto enclosure 230 at which point raised features 245 cause all switches 220 to operate to their off positions.

Figure 4:
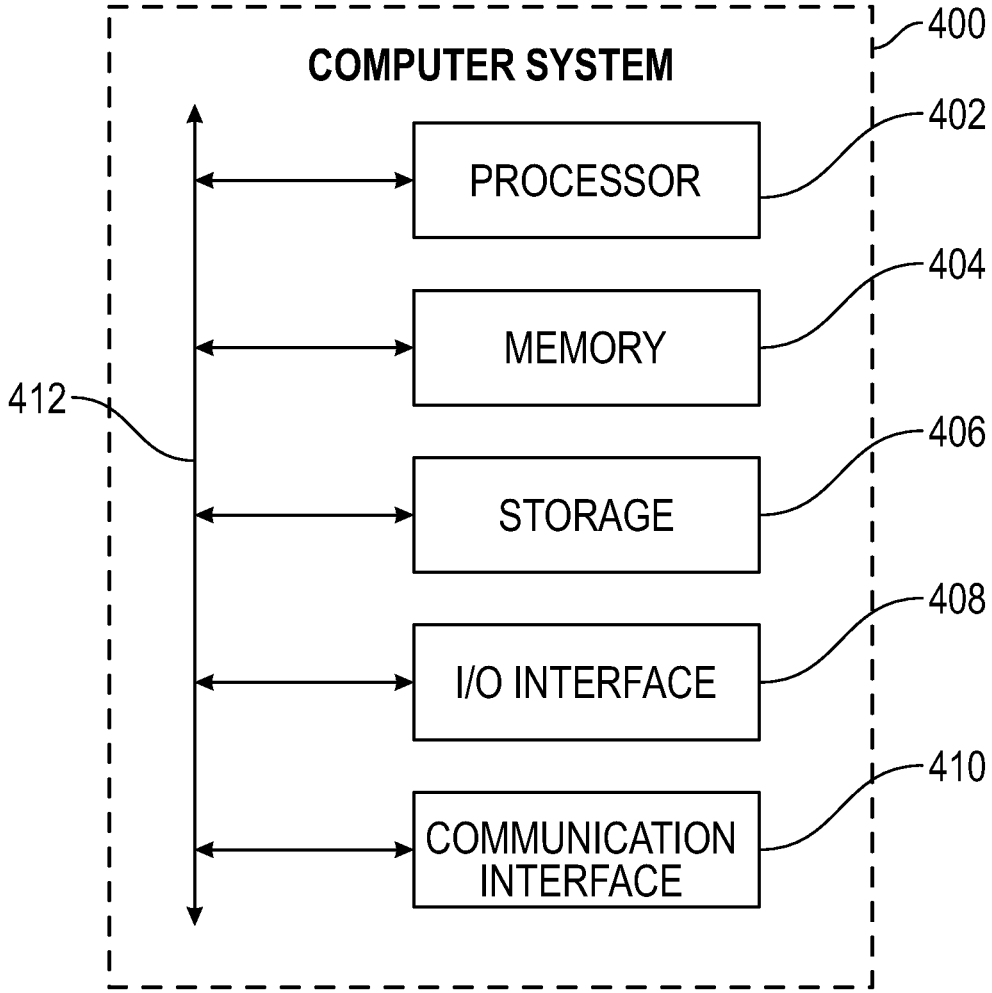
FIG. 4 is an example computer system that can be utilized to implement aspects of the various technologies presented herein, in accordance with one or more exemplary embodiments.

FIG. 4 illustrates an example computer system 400. In particular embodiments, one or more computer systems 400 provide functionality described or illustrated herein. In particular embodiments, software running on one or more computer systems 400 functionality described or illustrated herein. For example, one or more of timer device 320, switches 220, and relays 340 may be implemented by computer system 400. Particular embodiments include one or more portions of one or more computer systems 400. Herein, reference to a computer system may encompass a computing device, and vice versa, where appropriate. Moreover, reference to a computer system may encompass one or more computer systems, where appropriate.

This disclosure contemplates any suitable number of computer systems 400. This disclosure contemplates computer system 400 taking any suitable physical form. As example and not by way of limitation, computer system 400 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 400 may include one or more computer systems 400; be unitary or distributed; span multiple locations; span multiple machines; span multiple data centers; or reside in a cloud, which may include one or more cloud components in one or more networks. Where appropriate, one or more computer systems 400 may perform without substantial spatial or temporal limitation one or more steps of one or more methods described or illustrated herein. As an example, and not by way of limitation, one or more computer systems 400 may perform in real time or in batch mode one or more steps of one or more methods described or illustrated herein. One or more computer systems 400 may perform at different times or at different locations one or more steps of one or more methods described or illustrated herein, where appropriate.

In particular embodiments, computer system 400 includes a processor 402, memory 404, storage 406, an input/output (I/O) interface 408, a communication interface 410, and a bus 412. Although this disclosure describes and illustrates a particular computer system having a particular number of particular components in a particular arrangement, this disclosure contemplates any suitable computer system having any suitable number of any suitable components in any suitable arrangement.

In particular embodiments, processor 402 includes hardware for executing instructions, such as those making up a computer program. As an example, and not by way of limitation, to execute instructions, processor 402 may retrieve (or fetch) the instructions from an internal register, an internal cache, memory 404, or storage 406; decode and execute them; and then write one or more results to an internal register, an internal cache, memory 404, or storage 406. In particular embodiments, processor 402 may include one or more internal caches for data, instructions, or addresses. This disclosure contemplates processor 402 including any suitable number of any suitable internal caches, where appropriate. As an example, and not by way of limitation, processor 402 may include one or more instruction caches, one or more data caches, and one or more translation lookaside buffers (TLBs). Instructions in the instruction caches may be copies of instructions in memory 404 or storage 406, and the instruction caches may speed up retrieval of those instructions by processor 402. Data in the data caches may be copies of data in memory 404 or storage 406 for instructions executing at processor 402 to operate on; the results of previous instructions executed at processor 402 for access by subsequent instructions executing at processor 402 or for writing to memory 404 or storage 406; or other suitable data. The data caches may speed up read or write operations by processor 402. The TLBs may speed up virtual-address translation for processor 402. In particular embodiments, processor 402 may include one or more internal registers for data, instructions, or addresses. This disclosure contemplates processor 402 including any suitable number of any suitable internal registers, where appropriate. Where appropriate, processor 402 may include one or more arithmetic logic units (ALUs); be a multi-core processor; or include one or more processors 402. Although this disclosure describes and illustrates a particular processor, this disclosure contemplates any suitable processor.

In particular embodiments, memory 404 includes main memory for storing instructions for processor 402 to execute or data for processor 402 to operate on. As an example, and not by way of limitation, computer system 400 may load instructions from storage 406 or another source (such as, for example, another computer system 400) to memory 404. Processor 402 may then load the instructions from memory 404 to an internal register or internal cache. To execute the instructions, processor 402 may retrieve the instructions from the internal register or internal cache and decode them. During or after execution of the instructions, processor 402 may write one or more results (which may be intermediate or final results) to the internal register or internal cache. Processor 402 may then write one or more of those results to memory 404. In particular embodiments, processor 402 executes only instructions in one or more internal registers or internal caches or in memory 404 (as opposed to storage 406 or elsewhere) and operates only on data in one or more internal registers or internal caches or in memory 404 (as opposed to storage 406 or elsewhere). One or more memory buses (which may each include an address bus and a data bus) may couple processor 402 to memory 404. Bus 412 may include one or more memory buses, as described below. In particular embodiments, one or more memory management units (MMUs) reside between processor 402 and memory 404 and facilitate accesses to memory 404 requested by processor 402. In particular embodiments, memory 404 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 404 may include one or more memories 404, where appropriate. Although this disclosure describes and illustrates particular memory, this disclosure contemplates any suitable memory.

In particular embodiments, storage 406 includes mass storage for data or instructions. As an example, and not by way of limitation, storage 406 may include a hard disk drive (HDD), a floppy disk drive, flash memory, an optical disc, a magneto-optical disc, magnetic tape, or a Universal Serial Bus (USB) drive or a combination of two or more of these. Storage 406 may include removable or non-removable (or fixed) media, where appropriate. Storage 406 may be internal or external to computer system 400, where appropriate. In particular embodiments, storage 406 can be non-volatile, solid-state memory. In particular embodiments, storage 406 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 406 taking any suitable physical form. Storage 406 may include one or more storage control units facilitating communication between processor 402 and storage 406, where appropriate. Where appropriate, storage 406 may include one or more storages 406. Although this disclosure describes and illustrates particular storage, this disclosure contemplates any suitable storage.

In particular embodiments, I/O interface 408 includes hardware, software, or both, providing one or more interfaces for communication between computer system 400 and one or more I/O devices. Computer system 400 may include one or more of these I/O devices, where appropriate. One or more of these I/O devices may enable communication between a person and computer system 400. As an example, and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 408 for them. Where appropriate, I/O interface 408 may include one or more device or software drivers enabling processor 402 to drive one or more of these I/O devices. I/O interface 408 may include one or more I/O interfaces 408, where appropriate. Although this disclosure describes and illustrates a particular I/O interface, this disclosure contemplates any suitable I/O interface.

In particular embodiments, communication interface 410 includes hardware, software, or both providing one or more interfaces for communication (such as, for example, packet-based communication) between computer system 400 and one or more other computer systems 400 or one or more networks. As an example, and not by way of limitation, communication interface 410 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 410 for it. As an example, and not by way of limitation, computer system 400 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 400 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network, a Long-Term Evolution (LTE) network, or a 5G network), or other suitable wireless network or a combination of two or more of these. Computer system 400 may include any suitable communication interface 410 for any of these networks, where appropriate. Communication interface 410 may include one or more communication interfaces 410, where appropriate. Although this disclosure describes and illustrates a particular communication interface, this disclosure contemplates any suitable communication interface.

In particular embodiments, bus 412 includes hardware, software, or both coupling components of computer system 400 to each other. As an example and not by way of limitation, bus 412 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 412 may include one or more buses 412, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, FPGAs or ASICs), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112 (f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112 (f). For example, the terms "processor" and "controller" can be a class of structures, rather than one specific structure, and may be defined with functional terms, but that does not make it means-plus-function. Even under the broadest reasonable interpretation, in light of this paragraph of this specification, the claims are not intended to invoke 35 U.S.C. § 112 (f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification Those of skill in the art would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Skilled artisans will also readily recognize that the order or combination of components, methods, or interactions that are described herein are merely examples and that the components, methods, or interactions of the various embodiments of the present disclosure may be combined or performed in ways other than those illustrated and described herein.

Some embodiments may comprise processors, electronics devices, hardware devices, electronics components, logical circuits, memories, software codes, firmware codes, etc., or any combination thereof. Consistent with the foregoing, various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium can be coupled to the processor such that the processor can read information from, and write information to, the storage medium. In the alternative, the storage medium may be integral to the processor. The processor and the storage medium may reside in an ASIC. The ASIC may reside in a user terminal, base station, a sensor, or any other communication device. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. Computer-readable storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, a connection may be properly termed a computer-readable medium. For example, if the software can be transmitted from a website, server, or other remote source using a coaxial cable, fiber optic cable, twisted pair, or digital subscriber line (DSL), then the coaxial cable, fiber optic cable, twisted pair, or DSL, are included in the definition of medium. The terms Disk and disc can include compact disc (CD), laser disc, optical disc, digital versatile disc (DVD), floppy disk, and Blu-ray disc where disks usually reproduce data magnetically, while discs usually reproduce data optically with lasers. Combinations of the above should also be included within the scope of computer-readable media.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present disclosure, processes, machines, manufacture, compositions of matter, means, methods, or steps, presently existing or later to be developed that perform substantially the same function, in substantially the same way, or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A railroad crossing signal test system, comprising:

a power source;

a timer device;

a voltage regulator electrically coupled to the power source;

a first relay and a second relay;

a plurality of test leads, comprising:

a first test lead and a second test lead configured to operate a bell of a railroad crossing signal;

a third test lead configured to operate a left light of the railroad crossing signal;

a fourth test lead configured to operate a right light of the railroad crossing signal; and a fifth test lead configured to energize a common connection between the left light and the right light of the railroad crossing signal; and a plurality of switches, comprising:

a first switch configured to operate the bell of the railroad crossing signal, the first switch electrically coupled to the first test lead and an output of the voltage regulator and is configured to supply power from the voltage regulator to the first test lead;

a second switch configured to enable flashing of the left light of the railroad crossing signal, the second switch electrically coupled to a coil of the second relay and a normally-closed terminal of the first relay;

a third switch configured to enable flashing of the right light of the railroad crossing signal, the third switch electrically coupled to the fourth test lead and a normally-open terminal of the first relay; and a fourth switch configured to enable the railroad crossing signal test system, the fourth switch electrically coupled to the power source and the voltage regulator;

wherein:

the timer device is electrically coupled to a coil of the first relay and is configured to provide periodic electrical pulses;

the second test lead is electrically coupled to the output of the voltage regulator;

the third test lead is electrically coupled to a normally-closed terminal of the second relay; and the fifth test lead is electrically coupled to a common terminal of the second relay.

2. The railroad crossing signal test system of claim 1, wherein the power source is a battery that is both removable and rechargeable.

3. The railroad crossing signal test system of claim 1, wherein each of the plurality of switches comprises a light.

4. The railroad crossing signal test system of claim 3, wherein:

the light of the second switch is configured to flash in synchronization with the flashing of the left light of the railroad crossing signal; and the light of the third switch is configured to flash in synchronization with the flashing of the right light of the railroad crossing signal.

5. The railroad crossing signal test system of claim 1, wherein the flashing of the left light of the railroad crossing signal alternates with the flashing of the right light of the railroad crossing signal such that the left and right lights are prevented from being illuminated at the same time.

6. The railroad crossing signal test system of claim 1, further comprising:

an enclosure; and a removable lid comprising a plurality of raised features configured to disable the plurality of switches when the lid is in a closed position on the enclosure.

7. The railroad crossing signal test system of claim 6, wherein the plurality of test leads are retractable into the enclosure.

8. The railroad crossing signal test system of claim 1, further comprising a fuse that is installed between the power source and the fourth switch.

9. The railroad crossing signal test system of claim 1, wherein the periodic electrical pulses from the timer device cause the left light and the right light of the railroad crossing signal to flash between 35 and 65 flashes per minute.

10. A railroad crossing signal test system, comprising:

a power source;

a timer device electrically coupled to the power source and configured to provide periodic electrical pulses;

a first relay configured to alternately provide the periodic electrical pulses from the timer to a left light and a right light of a railroad crossing signal;

a second relay configured to alternately change a polarity of a common connection between the left light and the right light of the railroad crossing signal;

a plurality of test leads configured to electrically couple the railroad crossing signal test system to test terminals of the railroad crossing signal; and a plurality of switches, comprising:

a first switch configured to test a bell of the railroad crossing signal;

a second switch configured to enable flashing of the left light of the railroad crossing signal according to the periodic electrical pulses; and a third switch configured to enable flashing of the right light of the railroad crossing signal according to the periodic electrical pulses.

11. The railroad crossing signal test system of claim 10, further comprising a fourth switch configured to enable the railroad crossing signal test system.

12. The railroad crossing signal test system of claim 10, further comprising a voltage regulator electrically coupled to the power source.

13. The railroad crossing signal test system of claim 10, wherein the power source is a battery that is both removable and rechargeable.

14. The railroad crossing signal test system of claim 10, wherein each of the plurality of switches comprises a light.

15. The railroad crossing signal test system of claim 14, wherein:

the light of the second switch is configured to flash in synchronization with the flashing of the left light of the railroad crossing signal; and the light of the third switch is configured to flash in synchronization with the flashing of the right light of the railroad crossing signal.

16. The railroad crossing signal test system of claim 10, wherein the flashing of the left light of the railroad crossing signal alternates with the flashing of the right light of the railroad crossing signal such that the left and right lights are prevented from being illuminated at the same time.

17. The railroad crossing signal test system of claim 10, further comprising a fuse that is installed between the power source and the timer device.

18. The railroad crossing signal test system of claim 10, further comprising:

an enclosure; and a removable lid comprising a plurality of raised features configured to disable the plurality of switches when the lid is in a closed position on the enclosure.

19. The railroad crossing signal test system of claim 18, wherein the plurality of test leads are retractable into the enclosure.

20. The railroad crossing signal test system of claim 10, wherein the periodic electrical pulses from the timer device cause the left light and the right light of the railroad crossing signal to flash between 35 and 65 flashes per minute.

* * * * *